US005284739A

United States Patent [19]

Clarke et al.

[11] Patent Number: 5,284,739

[45] Date of Patent: Feb. 8, 1994

[54] PHOTOGRAPHIC SILVER HALIDE COLOR MATERIAL HAVING INCORPORATED THEREIN A BALLASTED HETEROCYCLIC-SULPHONHYDRAZIDE COLOR DEVELOPING AGENT

[75] Inventors: David Clarke, Watford; John D. Goddard, Pinner; Paul L. R. Stanley, Harrow; Nigel E. Milner, Watford, all of United Kingdom

[73] Assignee: Eastman Kodak Company, Rochester, N.Y.

[21] Appl. No.: 974,038

[22] Filed: Nov. 10, 1992

[30] Foreign Application Priority Data

Dec. 3, 1991 [GB] United Kingdom ..... 9125688

[51] Int. Cl.[5] ..... G03C 1/46

[52] U.S. Cl. ..... 430/504; 430/372; 430/551; 430/546; 430/380; 430/440; 430/566; 430/264

[58] Field of Search ..... 430/504, 372, 551, 546, 430/380, 440, 566, 264

[56] References Cited

U.S. PATENT DOCUMENTS

| | | | |
|---|---|---|---|
| 2,424,256 | 7/1947 | Schmidt et al. | 95/88 |
| 3,782,949 | 1/1974 | Olivaries et al. | 96/76 R |
| 4,481,268 | 11/1984 | Bailey et al. | 430/17 |
| 4,619,884 | 10/1986 | Singer | 430/223 |
| 4,923,783 | 5/1990 | Kobayashi et al. | 430/377 |
| 5,110,714 | 5/1992 | Furusawa et al. | 430/505 |
| 5,147,764 | 9/1992 | Bowne | 430/372 |

FOREIGN PATENT DOCUMENTS

| | | |
|---|---|---|
| 2128800 | 10/1972 | France . |
| 2-108043 | 4/1990 | Japan . |
| 83/00939 | 3/1983 | World Int. Prop. O. . |

*Primary Examiner*—Charles L. Bowers, Jr.
*Assistant Examiner*—Geraldine Letscher
*Attorney, Agent, or Firm*—Gordon M. Stewart

[57] ABSTRACT

Photographic materials having incorporated sulphonyhdrazide color developing agents. Such photographic materials have at least two color-forming units, each of which has a silver halide emulsion layer and a photographic coupler. A ballasted heterocyclic sulphonhydrazide color developing agent is present in the material in droplets of a high boiling point solvent. A method of forming a photographic color image using such materials is also provided.

4 Claims, No Drawings

PHOTOGRAPHIC SILVER HALIDE COLOR MATERIAL HAVING INCORPORATED THEREIN A BALLASTED HETEROCYCLIC-SULPHONHYDRAZIDE COLOR DEVELOPING AGENT

FIELD OF THE INVENTION

The present invention relates to photographic silver halide color materials and to processes for the formation of photographic color images.

BACKGROUND OF THE INVENTION

Existing commercial photographic silver halide color materials form dye images by the reaction of oxidized p-phenylenediamine color developers with a color coupler. The color developing solutions employed contain the color developing agent and used developer solutions need to be disposed of safely. Attempts have been made to incorporate p-phenylenediamine color developing agents into silver halide photographic materials but these have had little success largely due to the pronounced staining produced.

The use of aryl sulphonhydrazides as color developers in aqueous color developer solutions which form an azo dye on coupling with a color coupler are described in U.S. Pat. No. 2,424,256. The hues of such dyes are not suitable for full color reproduction.

U.S. Pat. No. 4,481,268 describes the use of certain aryl- and heterocyclic-sulphonhydrazides to produce metallizable azo or azomethine dyes which are subsequently metallized to form very light-stable dye images. While the specification does indicate that such sulphonhydrazides can be incorporated in the photographic material, no further information or examples are given. The hue of the dye is, of course, altered by the metallization process.

SUMMARY OF THE INVENTION

The present invention provides photographic materials with incorporated color developing agent which are capable of providing full color images. The processing solutions used do not contain color developing agents and any products released into the processing solutions are relatively harmless.

According to the present invention there is provided a color photographic material comprising at least two color-forming units sensitive to different regions of the spectrum each comprising a silver halide emulsion layer and, in or adjacent said layer, a photographic color coupler characterised in that the material contains incorporated therein in droplets of a high boiling solvent a ballasted heterocyclicsulphonhydrazide color developing agent.

The present invention also provides a method of forming a photographic color image which comprises exposing and processing materials of the present invention.

DETAILED DESCRIPTION OF THE INVENTION

The preferred sulphonhydrazide color developing agent has the formula:

$$R—NHNH—SO_2—R^1 \quad (1)$$

wherein

R is a heterocyclic group which may be substituted, and $R^1$ is an alkyl, aryl or heterocyclic group, either of which may be substituted, and wherein R or $R^1$ contains a ballasting group of such size and configuration as to render the compound non-diffusible.

When the ballast group is in group R, the diazo compound formed on development is unable to diffuse and a water-soluble sulphinato compound is formed which washes out of the photographic material. When, however, the ballast group is part of $R^1$, a mobile diazonium compound is formed while the sulphinate compound is ballasted and remains in the material.

The high boiling solvent used to incorporate the color developer in the photographic material may be any solvent already known as a coupler solvent (and used for incorporating couplers into photographic materials). Many such solvents are listed in Research Disclosure Item 308119, December 1989 published by Kenneth Mason Publications, Emsworth, Hants, United Kingdom. The color developer may be incorporated in the same or different droplets of coupler solvent used for the couplers themselves.

When the ballast group is in group R, it is preferred to co-disperse both coupler and color developing agent in the same droplet of coupler solvent.

The heterocyclic sulphonhydrazides may have one of the following general formulae:

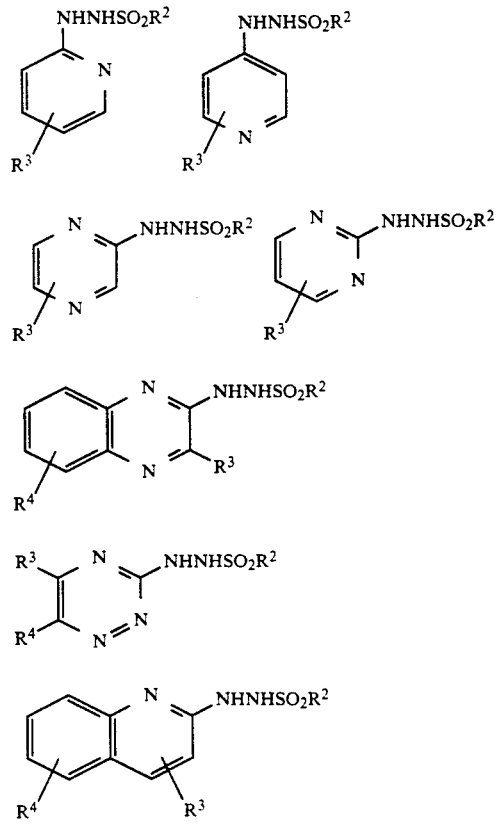

-continued

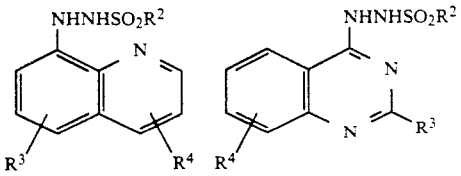

$R^2$ is alkyl or substituted alkyl, or a substituted or unsubstituted aromatic heterocyclic group, $R^3$ is H, alkyl, aryl, alkoxy, Cl, F, or, especially, an electron-withdrawing group such as $CF_3$, COMe, $CONH_2$, COOAlkyl CN, $SO_2R$, $SO_2NHR$, and $R^4$ is H or a general organic substituent.

In all the above examples, the developer may be ballasted through a suitable group present in $R^2$ and/or the substitutes $R^3$ and $R^4$ on the heterocyclic ring.

Examples of sulphonhydrazides are:

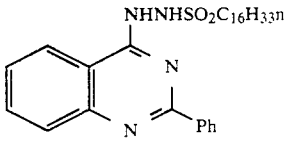

(D1)

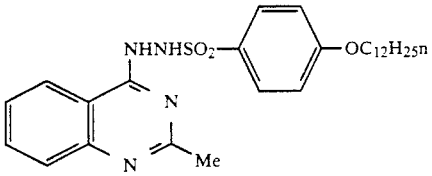

(D2)

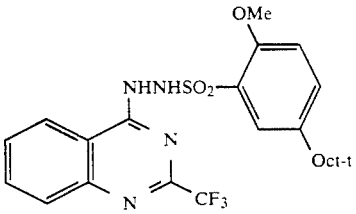

(D3)

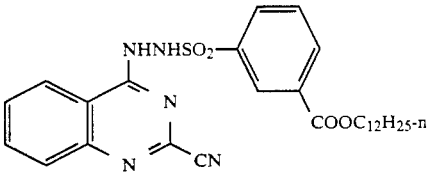

(D4)

-continued

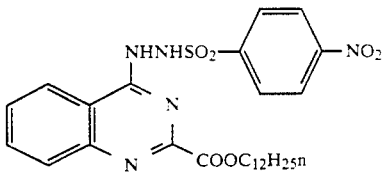

(D5)

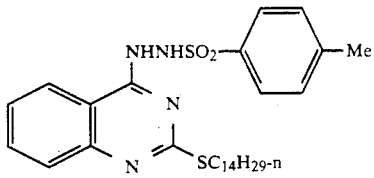

(D6)

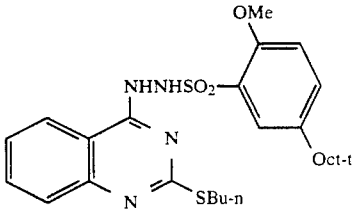

(D7)

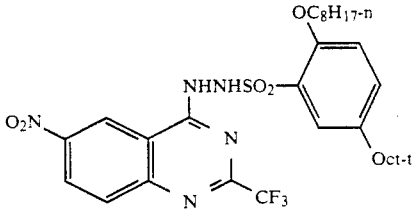

(D8)

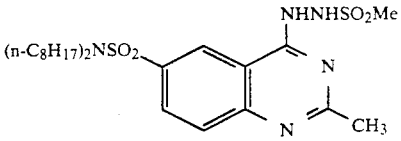

(D9)

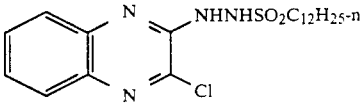

(D10)

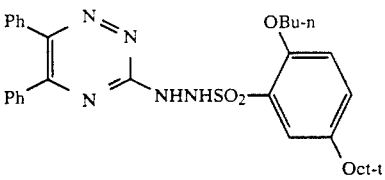

(D11)

Examples of couplers which may be used are:

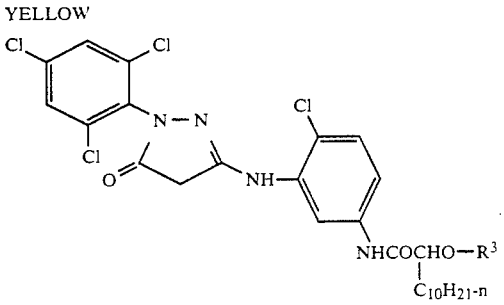

(Y1)

-continued (Y2)

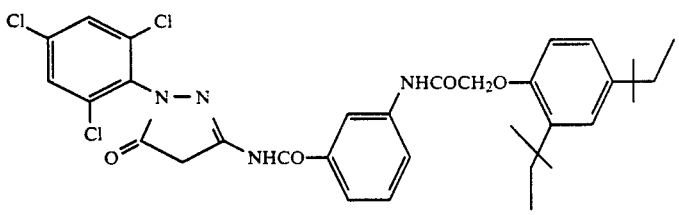

(Y3)

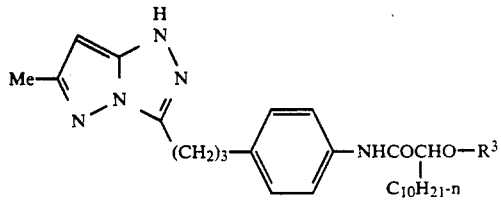

$R^3$ =

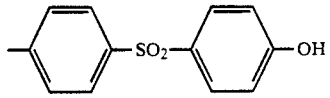

MAGENTA (M1)

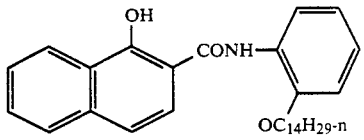

(M2)

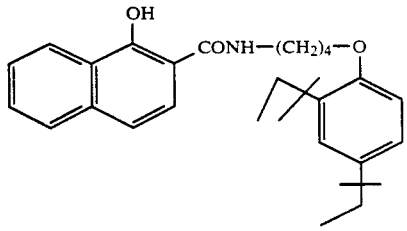

(M3)

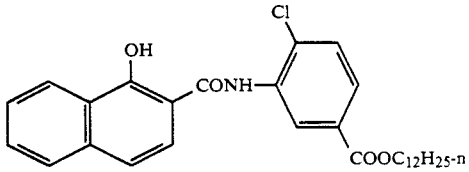

The present photographic materials, after imagewise exposure, may be processed by treatment in an alkaline solution. In such a process oxidized color developer forms in areas of silver halide development and the oxidized form of the developer couples with the coupler to form image dye.

In a preferred embodiment, the alkaline solution contains an electron transfer agent (ETA), for example a pyrazolidinone. A specific ETA that may be used is 4-hydroxymethyl-4-methyl-1-phenylpyrazolidin-3-one.

The sulphonhydrazide developer compounds may be prepared by the following scheme or analogous methods:

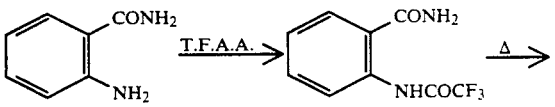

-continued

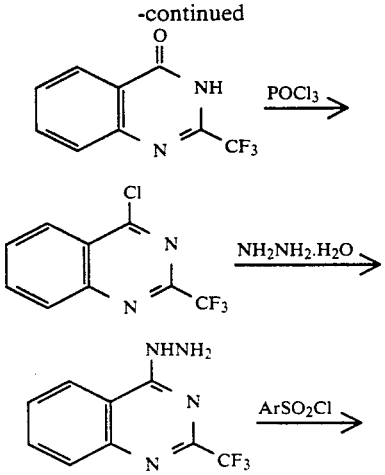

-continued

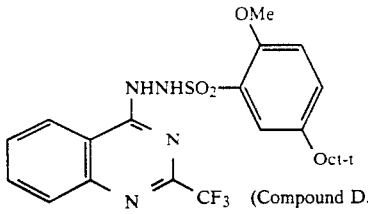

(Compound D3)

A specific preparation is described below.

PREPARATIVE EXAMPLE 1

2-(Trifluoroacetamido)benzamide

2-Aminobenzamide (70.0 g, 0.52 mole) was dissolved in THF (300 ml) and cooled in an ice-bath. Trifluoroacetic anhydride (72.8 ml, 0.52 mole) was added dropwise with stirring over a period of one hour. After stirring a further 2 hours, the white suspension which had formed was poured onto ice-water (11). The white precipitate was collected by filtration and air dried. Yield of product was 73.5 g (62%).

Found: C, 46.8; H, 3.3; N, 12.1% ; $C_9H_7F_3N_2O_2$ Requires: C, 46.6; H, 3.0; N, 12.1%.

2-Trifluoromethyl-4-quinazolinone 2-(Trifluoroacetamido)benzamide (73.0 g, 0.31 mole) was heated in ethylene glycol (150ml) in an oil bath with stirring. The amide dissolved at around 130° and product began to precipitate out at 150°. The temperature was held at 150° for a further 1 hour before cooling. The solid was filtered off washing well with cold water to give the product, 55.7 g (84%).

Found: C, 50.4; H, 2.6; F, 26.4; N, 13.0% ; $C_9H_5F_3N_2O$ Requires: C, 50.5; H, 2.4, F, 26.6; N, 13.1%.

4-Chloro-2-trifluoromethylquinazoline

2-Trifluoromethyl-4-quinazoline (24.0 g, 0.11 mole) was refluxed in phosphoryl chloride (120 ml) using an oil bath. After 1.5 h, the solution was cooled and excess phosphoryl chloride removed in vacuo. The crude product was extracted in ethyl acetate (200 ml) and washed successively with sodium bicarbonate solution then water. After drying the organic solution, removal of solvent gave an oil which was eluted down a silica gel chromatography column with dichloromethane. The product was collected as a colorless oil which rapidly crystallised. Yield is 25.4 g (91%).

Found: C, 46.5; H, 1.9; F, 24.1; N, 12.0%; $C_9H_4ClF_3N_2$ Requires: C, 46.5; H, 1.7; F, 24.5; N, 2.0%.

4-Hydrazino-2-trifluoromethylquinazoline

4-Chloro-2-trifluoromethylquinazoline (46.4 g, 0.2 mole) was taken up in ethanol (500 ml). Hydrazine hydrate (20 ml, 0.4 mole) was added and the contents refluxed for 2 hours. On cooling, the yellow precipitate was filtered and slurried in water (500 ml) to removed hydrazine hydrochloride. Filtration gave the product as a yellow crystalline solid, 34.5 g (76%).

Found: C, 47.3; H, 3.2; F, 24.6; N, 24.7%; $C_9H_7F_3N_4$ Requires: C, 47.4; H, 3.1; F, 25.0; N, 24.5%.

Compound 3

4-Hydrazino-2-trifluoromethylquinazoline (32.4 g, 0.14 mole) was taken up in DMF (250 ml) and triethylamine (30 ml, 0.21 mole). A solution of 2-methoxy-5-t-octyl-benzenesulphonyl chloride (45.2 g, 0.14 mole) in THF (50 ml) was added dropwise with stirring at temperature over 0.5 hours, then the mixture stirred a further 2 hours. A small amount of white solid (triethylamine hydrochloride) was filtered off and discarded while the filtrate was evaporated to dryness under vacuum. The resulting dark brown oil was purified by column chromatography eluting with 3:1 (v/v) 60-80 petrol/ethyl acetate. The product was collected and solvent removed to give a cream colored solid, 29.7 g (41%), mp 186°-189°.

Mass spec showed M+ at 510 m/e.

HPLC gave a purity of 100%.

Found: C 56.4; H, 5.7; F, 11.5; N, 10.7; S, 6.3%;

$C_{24}H_{29}F_3N_4O_3S$Requires: C, 56.1; H, 5.7; F, 11.2; N, 11.0; S, 6.3%.

In the following examples, the testing was done as described below.

Dispersions

The coupler dispersions used contained (w/w) 6.0% gelatin, 8.8% coupler, 1 molar equivalent of developer, and coupler solvents in he ratio coupler: tricresylphosphate: 2-(2-butoxyethoxy)ethyl acetate 1.0 : 0.5 : 1:5.

The dispersions were washed for 6 horus at 4° C.

Coatings

The coupler/developer dispersions were coated with a (green-sensitised) silver bromoiodide emulsion in the following format:

| | | |
|---|---|---|
| Gel supercoat | Gelatin | 1.5 $gm^{-2}$ |
| Emulsion Layer | Silver bromoiodide | 1.61 $gm^{-2}$ |
| | Coupler (+dev) | 1.04 mmol $m^{-2}$ |
| | Gelatin | 2.42 $gm^{-2}$ |
| | Bis(vinylsulphonyl)-methane (hardener) | 0.06 $gm^{-2}$ |
| Support | Cellulose Acetate | |

The coatings were slit and chopped into 12"×35 mm strips and exposed (0.1 sec, DL V+WR 9 filters) and processed through the following sequence, using an activator solution of the given composition:

| Processing Sequence | |
|---|---|
| Activator | 2.5 min |
| Wash | 1.0 min |
| Bleach | 4.0 min |
| Wash | 2.0 min |
| Fix | 4.0 min |
| Wash | 2.0 min |
| Base Dip | 1.0 min |

| Activator Solution | |
|---|---|
| $Na_2CO_3$ | 26.5 g/l |
| $NaHCO_3$ | 6.3 |
| $Na_2SO_3$ | 2.0 |
| NaBr | 1.0 |
| 4-hydroxymethyl-4-methyl-1-phenylpyrazolidin-3-one | 0.2 |
| pH = 10.4 | |

The post-process base dip (pH 10.4 solution -$Na_2CO_3$ 26.5 g/l and $NaHCO_3$ 6.3 g/l) is required to obtain the azo-dye in its full-colored anionic form for the magenta dyes.

The coatings marked with an * were processed through an activator solution formulation with the following composition:

| | |
|---|---|
| $K_2CO_3$ | 30.0 g/l |
| NaBr | 1.0 g |
| $Na_2SO_3$ | 0.2 g |
| 4-hydroxymethyl-4-methyl-1-phenylpyrazolidin-3-one | 0.2 g |
| This solution has pH = 11.6 | |

Maximum density (Dmax) was obtained using a SPADE densitometer. Dye hues (λmax) were obtained using a Hewlett Packard HP8450A diode array spectrophotometer.

The examples are included for a better understanding of the invention.

EXAMPLE 1

Single Layer, Single Color Coating Results (Co-dispersion of Coupler with D286HCU Developer)

| Coupler/Developer | Dye Color | Dmax (status M) | λmax (nm) |
|---|---|---|---|
| *Y2/D3 | Yellow | 0.74(B) | 478 |
| *Y1/D3 | Yellow | 1.77(B) | 466 |
| *M2/D3 | Magenta | 1.35(G) | 566 |
| M3/D3 | Magenta | 1.14(G) | 566 |
| M1/D3 | Magenta | 0.70(G) | 568 |

(*original activator composition pH 11.6)

EXAMPLE 2

Single Layer, Single Color Coating Results (Co-Dispersion vs. separate Dispersions)

| Coupler/Developer | Dye Color | Dmax (status M) | λmax (nm) |
|---|---|---|---|
| Y1/D3 (co-dispersion) | Yellow | 1.44(B) | 464 |
| Y1/D3 (separate dispersions) | Yellow | 1.43(B) | 464 |

EXAMPLE 3

Single Layer, Single Color Coating Results

Comparisons of ballast in heterocycle vs. ballast in sulphonyl function (codispersion of Coupler with Developer)

| Coupler/ Developer | Ballast Position | Dye Color | Dmax (status M) | λmax (nm) |
|---|---|---|---|---|
| Y1/D6 | Heterocycle | Yellow | 1.12(B) | 464 |
| Y1/D7 | Sulphonyl Function | Yellow | 0.78(B) | 464 |

We claim:

1. A color photographic material comprising at least two color-forming units sensitive to different regions of the spectrum each comprising a silver halide emulsion layer and, in or adjacent said layer, a photographic color coupler characterised in that the material contains incorporated therein in droplets of a high boiling solvent a ballasted heterocyclicsulphonhydrazide color developing agent.

2. A photographic material as claimed in claim 1 in which the sulphonhydrazide color developing agent has the formula:

$$R—NHNH—SO_2—R^1 \quad (1)$$

wherein

R is a heterocyclic group which may be substituted, and $R^1$ is an alkyl, aryl or heterocyclic group, either of which may be substituted, and wherein R or $R^1$ contains a ballasting group of such size and configuration as to render the compound non-diffusible.

3. A photographic material as claimed in claim 1 in which the sulphonhydrazide has one of the following general formulae:

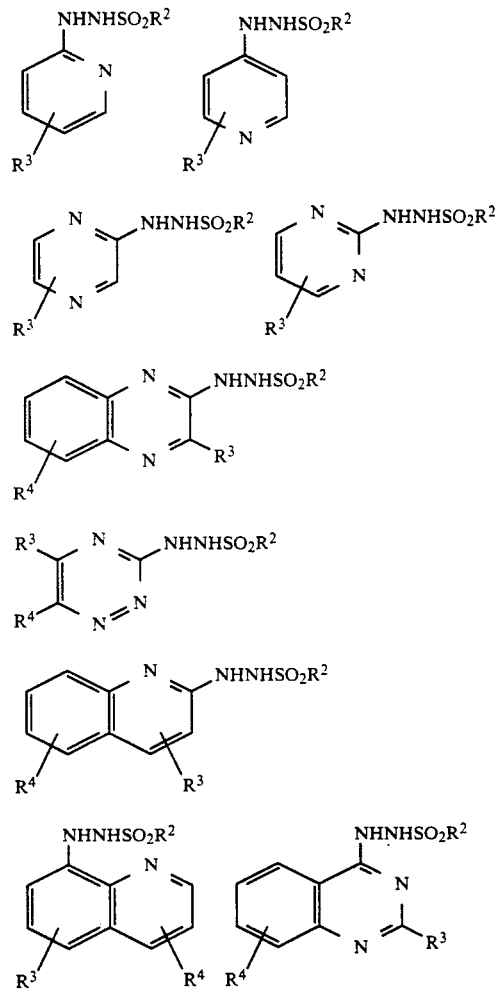

wherein:

$R^2$ is alkyl or substituted alkyl, or a substituted or unsubstituted aromatic heterocyclic group;

$R^3$ is H, alkyl, aryl, alkoxy, Cl, F, or an electron-withdrawing group; and $R^4$ is H or an organic substituent.

4. A photographic material as claimed in claim 2 in which the sulphonhydrazide is one of the following compounds:

(D1)
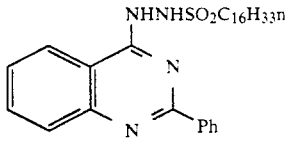
(D2)
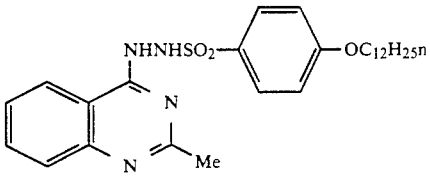
(D3)
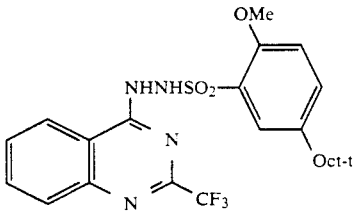
(D4)
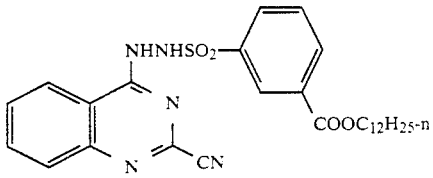
(D5)
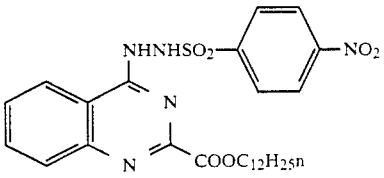
-continued
(D6)
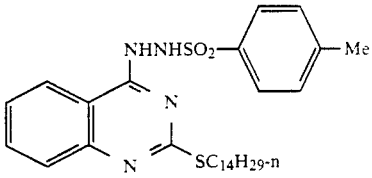
(D7)
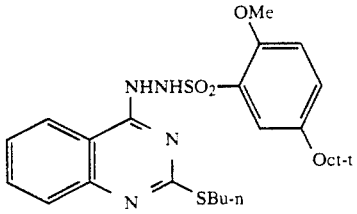
(D8)
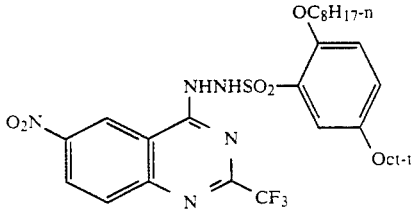
(D9)
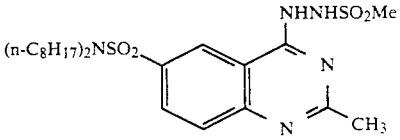
(D10)
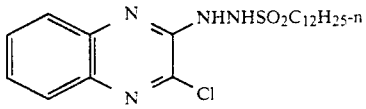
(D11)
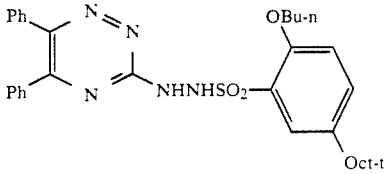
* * * * *